US005483875A

United States Patent [19]

Turecek et al.

[11] Patent Number: 5,483,875

[45] Date of Patent: Jan. 16, 1996

[54] PAPERBOARD RUNNERS AND PAPERBOARD PALLETS

[75] Inventors: John Turecek, Brampton; Richard Ciupak, Etobicoke, both of Canada

[73] Assignee: Coleman Containers Limited, Mississauga, Canada

[21] Appl. No.: 188,847

[22] Filed: Jan. 31, 1994

[51] Int. Cl.[6] ..... B65D 19/00

[52] U.S. Cl. ..... 108/51.3; 108/56.3

[58] Field of Search ..... 108/51.3, 51.1, 108/56.1, 56.3

[56] References Cited

U.S. PATENT DOCUMENTS

| | | | |
|---|---|---|---|
| 2,494,730 | 1/1950 | Tavrsby | 108/51.3 X |
| 2,908,464 | 10/1959 | Traudt et al. | 108/51.3 |
| 2,957,668 | 10/1960 | Norquist et al. | 108/51.3 |
| 3,464,370 | 9/1969 | Martin | 108/51.3 |
| 3,480,196 | 11/1969 | De Simas | 108/51.3 X |
| 4,966,084 | 10/1990 | Motomaro | 108/51.3 |
| 5,176,090 | 1/1993 | Roberts et al. | 108/51.3 |
| 5,222,444 | 6/1993 | Youell, Jr. et al. | 108/51.3 |
| 5,285,731 | 2/1994 | McIntyre | 108/51.3 |

*Primary Examiner*—Jose V. Chen

*Attorney, Agent, or Firm*—Eugene J. A. Gierczak

[57] ABSTRACT

A runner for a shipping pallet is described which includes a sheet of paperboard folded to present spaced apart top and bottom walls, a pair of side walls and a central web running parallel to and between those side walls. The central web extends from the top wall to the bottom wall. The top wall and central web have cutout slots to receive braces made of paperboard. Each brace is formed from a multiply folded paperboard blank that has been slotted to form a block which mates with the central web of the runner when the block is inserted into one of the slots. Paperboard pallets are also described in which these runners are used in co-operation with paperboard decking sheets which may also have cutouts to mate with the runners.

18 Claims, 14 Drawing Sheets

PAPERBOARD RUNNERS AND PAPERBOARD PALLETS

FIELD OF INVENTION

This invention relates to a runner for a paperboard pallet and particularly relates to a paperboard runner having slots presented in the top wall portion and central wall portion adapted to receive a folded brace.

BACKGROUND OF THE INVENTION

Pallets have, heretofore, been made out of wood and other materials such as plastic in order to serve as supports for moving items which are loaded thereon.

Pallets have also heretofore been made from paperboard products such as cardboard or the like in order to produce light weight and environmentally friendly pallets. Such pallets can include a bottom and top sheet or deck as well as runners interposed therebetween. Runners generally comprise of a folded sheet of paperboard. Such constructions of runners and paperboard pallets have, as one of the goals, to produce a rigid and strong device for supporting the load.

Examples of such prior art devices are illustrated in United States Patent Nos. U.S. Pat. No. 5,001,991 which relates to an improved pallet assembly which comprises a plurality of elongated stringer members, each being fabricated from multiple plies of web material, and a multiplicity of elongated decking members traversing the stringer members and assembled with them adjacent the top side of the pallet assembly. At least one of the stringer members has upwardly and transversely extending indentations, to define a neck portion at the bottom side thereof. A hollow, tubular reinforcing piece is inserted upwardly into the indentations of an associated stringer member, with the neck portion thereof extending downwardly thereinto, so that the components are securely and tightly inter-engaged with one another.

U.S. Pat. No. 5,230,291 which relates to a pallet as might be used to support cargo during that cargo's transportation or storage. The pallet is constructed of paper. The pallet design involves a central platform or deck constructed of a honeycomb filler bounded on the bottom surfaces by a corrugated sheet. The upper surface of the central platform may be covered with a corrugated sheet or heavy paper stock. Additionally, the upper and/or lower sheets may be folded over the edges of the honeycomb core and fastened to the other side. Runners or legs are included to support the central platform.

U.S. Pat. No. 5,176,090 which relates to a lightweight, completely recyclable paper pallet which is provided and which can be produced, shipped and stored as two die cut pieces, and which can be readily constructed without gluing to form a complete pallet. Preferably, the pallet includes a planar main panel having a pair of laterally spaced apart, side marginal, box-like underlying support sections; a box-like central support section coupled to the main panel completes the construction. Interconnection of the marginal support sections and central support section is accomplished by means of notched locking elements passing through strategically located slots in main panel and inter-fitting with upright notched reinforcing panels provided along the length of the supports.

U.S. Pat. No. 3,626,860 which relates to a foldable expendable four-way entry pallet. Log sleeves are formed in pairs at opposite ends of a piece of double-faced single-wall corrugated board and the entire intervening web is adhesively secured to the underside of the deck.

U.S. Pat. No. 4,986,418 which relates to a blank preform and tray pallet.

Finally U.S. Pat. No. 5,222,444 relates to paperboard runners and paperboard pallets constructed therewith.

It is an object of the present application to provide a runner having improved strength characteristics than constructed in the prior art.

It is also an object of this invention to provide an improved method of constructing runners and paperboard pallets. The broadest aspect of this invention relates to a runner for a pallet comprising a sheet of paperboard folded to present spaced top and bottom walls; a pair of side walls, a central web disposed between said side walls and depending from said top wall to said bottom wall; the top wall having top wall slots; the central web having central web slots aligned with said top wall slots; and at least one brace of paperboard having a plurality of folds to present a slotted block for engagement with one of said slots. A further aspect of this invention is related to a runner for a pallet comprising a folded sheet of paperboard and a brace: said sheet comprising: a first pair of spaced parallel fold lines for defining a bottom wall; a second pair of parallel fold lines spaced from and parallel to said first pair of parallel fold lines for defining a pair of side walls between said first fold lines and said second fold lines; a third pair of parallel fold lines parallel to, and bracketing said second pair of parallel fold lines for defining top wall portions between said second pair of fold lines and said third pair of fold lines; a pair of longitudinal edges parallel to and bracketing said third pair of fold lines to define central wall portions therebetween; at least one pair of longitudinally aligned cut-outs, each pair of longitudinally aligned cut-outs extending from one of said second fold lines across said top wall portion, across said third fold line and across a portion of said central wall portion to define a top wall slot portion in said top wall and a central wall rebate in said central web portion; said sheet foldable along said first, second and third fold lines to a folded position; said central wall portions depending from said top wall portions to said bottom wall in said folded portion; each pair of aligned top wall slot portions cooperating to define a top wall slot in said folded position; said brace comprised of paperboard having a plurality of folds to present a slotted block for insertion through said top wall slot to seat in said rebate.

Yet a further aspect of this invention is related to a paperboard pallet comprising: a bottom sheet having a pair of spaced fold lines for defining a pair of spaced upstanding bottom sheet sidewall portions; a runner comprising a sheet of paperboard having: a first pair of spaced parallel fold lines for defining a bottom wall; a second pair of parallel fold lines spaced from said first pair of parallel fold lines for defining a pair of side walls; a third pair of parallel fold lines spaced from said second pair of parallel fold lines for defining top wall portions, and central wall portions from said third pair of parallel fold lines and said outer periphery of said paperboard; said central wall portions depending from said top wall portions to said bottom wall; slots extending from said second fold lines across said top wall portions and a portion of said central wall portions; a top sheet for overlying said top wall of said runner; an adhesive for securing said bottom wall of said runner to said bottom sheet and said top portions of said runner to said top sheet; a brace of paperboard having a plurality of holes to present a slotted block for insertion into said slots of said runner.

DRAWINGS

These and other objects and features shall now be described in relation to the following drawings.

DESCRIPTION OF THE INVENTION

Figure 1:
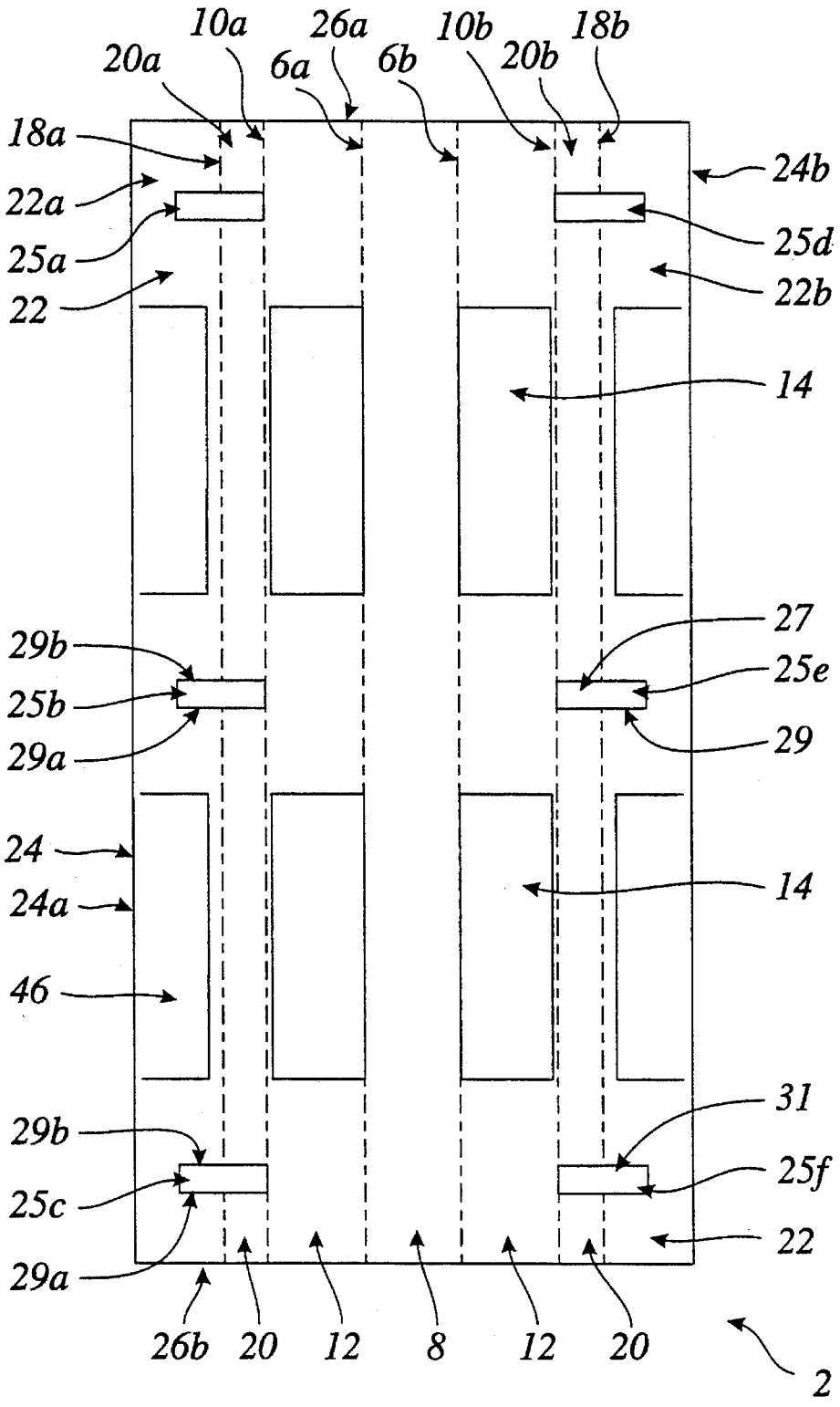
FIG. 1 is a top plan view of the paperboard blank to produce the runner in accordance with the invention herein.

Like parts have been given like numbers throughout the figures. FIG. 1 is top plan view of the blank 2 to produce the paperboard runner 4. The paperboard runner 4 can comprise of cardboard or similar material which is well-known to those persons skilled in the art.

Figure 6:
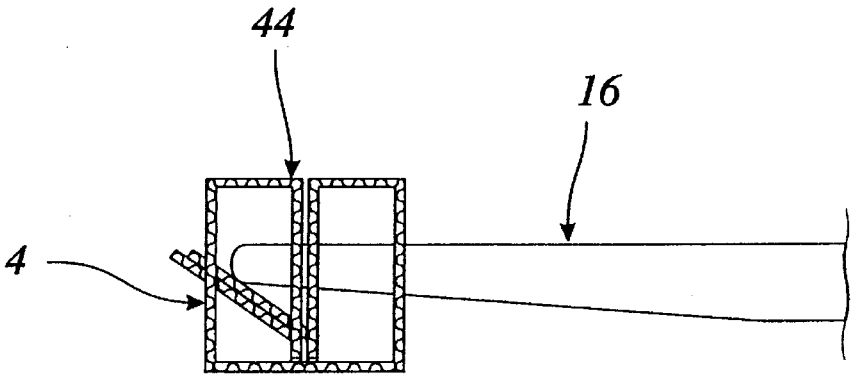
FIG. 6 is an end view of the runner in combination with the fork lift.

The blank 2 has a first pair 6 of longitudinal, parallel fold lines which define fold lines 6*a* and there between 6*b* a bottom wall 8 extending the length of blank 2. The blank 2 also has a second pair 10 of longitudinal parallel second fold lines 10*a* and 10*b* which are spaced outboard of, equidistant from, and parallel to first pair of parallel fold lines 6 so as to define side walls 12. The side walls 12 include a plurality cut out apertures, or of holes 14 which are adapted to receive the fork lifts 16 of a fork lift truck as shown in FIG. 6.

Figure 3:
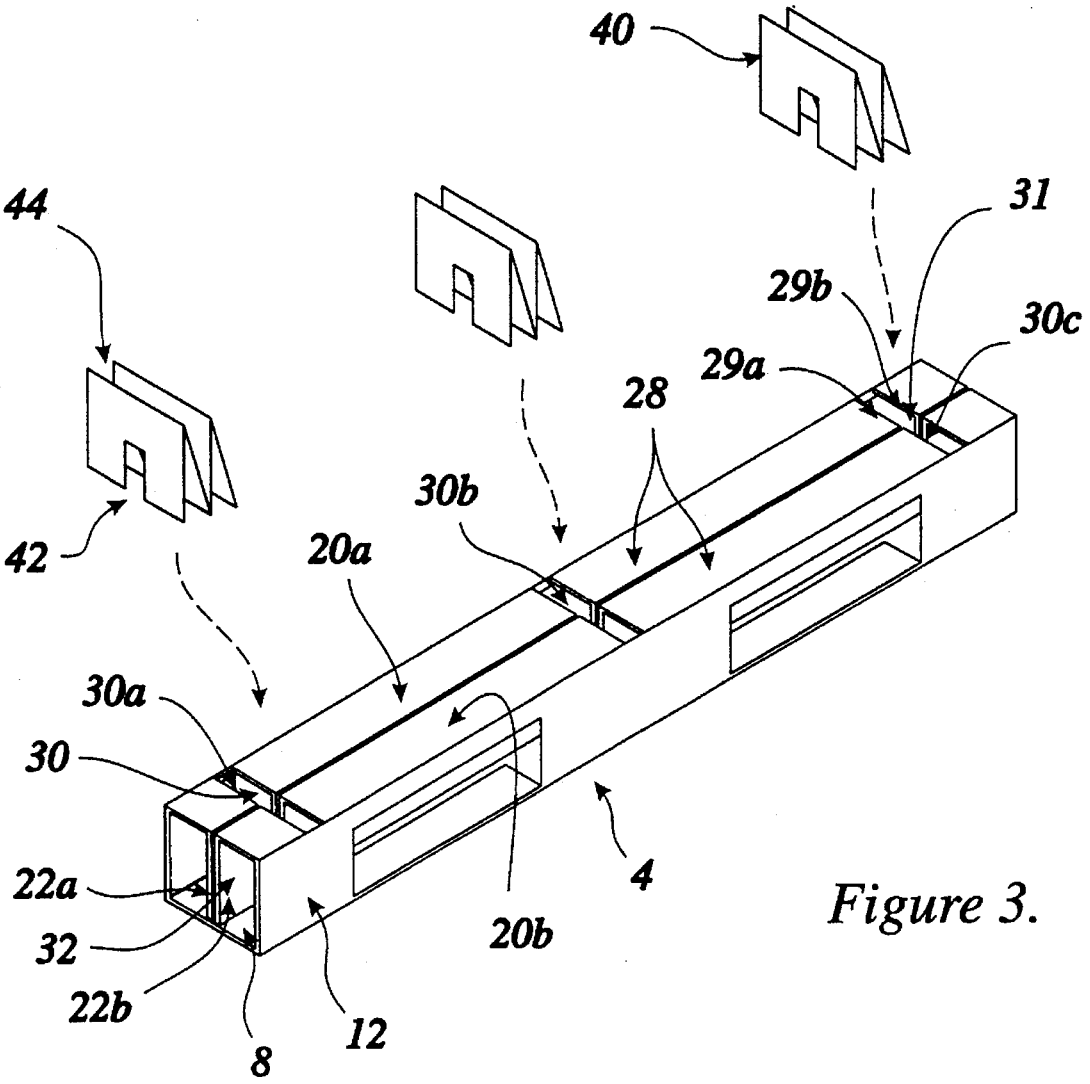
FIG. 3 is a perspective view for assembling the runner.

The blank 2 also includes longitudinal, parallel fold lines 18, individually 18*a* and 18*b*, in turn outboard of, equidistant from, and parallel to fold lines 10*a* and 10*b* respectively, which, in combination with fold lines 10*a* and 10*b* define top wall portions 20*a* and 20*b* running the length of blank 2, portion 20*a* bounded by folds 10*a* and 18*a*, and portion 20*b* bounded by folds 10*b* and 18*b*, as best illustrated in FIG. 3.

The blank 2 also includes central wall portions 22, being 22*a* and 22*b* which are defined between the third fold lines 18, longitudinal peripheral edges 24*a* and 24*b* of blank 2, portion 22*a* lying between fold line 18*a* and edge 24*a*, and portion 22*b* lying between fold line 18*b* and edge 24*b*. The blank 2 also includes opposite end peripheral edges 26*a* and 26*b* as shown in FIG. 1. Finally, as shown in FIG. 1 blank 2 comprises six apertures, or cut-outs 25, being 25*a*, 25*b*, 25*c*, 25*d*, 25*e*, and 25*f*. Cut-outs 25*a*, 25*b*, and 25*c* extend perpendicularly from fold line 10*a* outward beyond fold line 18*a*, such that those cut-outs straddle fold line 18*a*. Cut outs 25*d*, 25*e*, and 25*f* similarly extend outward from fold line 10*b* to straddle fold line 18*b*. As such each of cut-outs 25 has a first portion 27 lying in, and extending substantially fully across one of the top wall portions, be it 20*a* or 20*b*, and a second portion 29 lying in, and extending partially across, one of the central wall portions, be it 22*a* or 22*b*. Second portion 29 is bounded by opposed peripheral edges 29*a* and 29*b* of blank 2, those edges being perpendicular to longitudinal fold lines 18. Notably cut-outs 25*a* and 25*d* are in longitudinal respects disposed in one end region of blank 2, cut-outs 25*b* and 25*e* are disposed more or less centrally with respect to the longitudinal extent of blank 2, and cut-outs 25*c* and 25*f* are disposed in the other end region of blank 2.

The runner 4 is easily folded. along first, second and third pairs of fold lines 6, 10, and 18 respectively so as to present the configuration shown in FIG. 3 in which each fold ideally approximates a right-angle. As folded, the two top wall portions 20*a* and 20*b* define a top wall 28 which presents a series of slots 30, being 30*a*, 30*b*, and 30*c* as indicated for the near end, central, and far end slots respectively. It will be noted that each of slots 30 is formed from portions of cut-outs 25. As blank 2 is folded central wall portions 22*a* and 22*b* are placed in substantially planar back-to-back contact, which is to say that the back sides of portions 22*a* and 22*b*, which were facing downward in FIG. 1, have been bent upward, then inward, then downward, through 270 degrees of arc to meet each other. Thus slots 30 are formed. Slot 30*a* for example, comprises first portion 27 of cut-out 25*a* lying in top wall 20*a* and the now adjacent first portion 27 of cut-out 25*d* lying in top wall 20*b*. Slots 30*b* and 30*c* are formed similarly. Slot 30*a* is clear to a depth corresponding to the extent of second portions 29 of cut-outs 25*a* and 25*d* lying in central wall portions 22*a* and 22*b*. As such second portions 29 of cut-outs 25*a* and 25*d* may also be described as slots or rebates 31. Each rebate 31 comprises two cut-outs 25 lying in back to back central wall portions 22 in central wall portions 22*a* and 22*b* aligned with slot 30*a* in top wall 28. The two central wall portions 22*a* and 22*b*, as shown in FIG. 1 themselves depend from the top wall portions 20*a* and 20*b* so as to extend to and contact bottom wall 8. Moreover, two central walls portions 22*a* and 22*b* in contacting one another in the back to back fashion described, intermediate side walls 12, define a central web 32. By adjusting the location of fold lines 6 and 10 relative to fold lines 18, central web 32 may be located centrally between side wall portions 12 or closer to one of side wall portions 12 than the other. In the preferred embodiment central web 32 is equidistantly located intermediate side walls 12.

Figure 2:
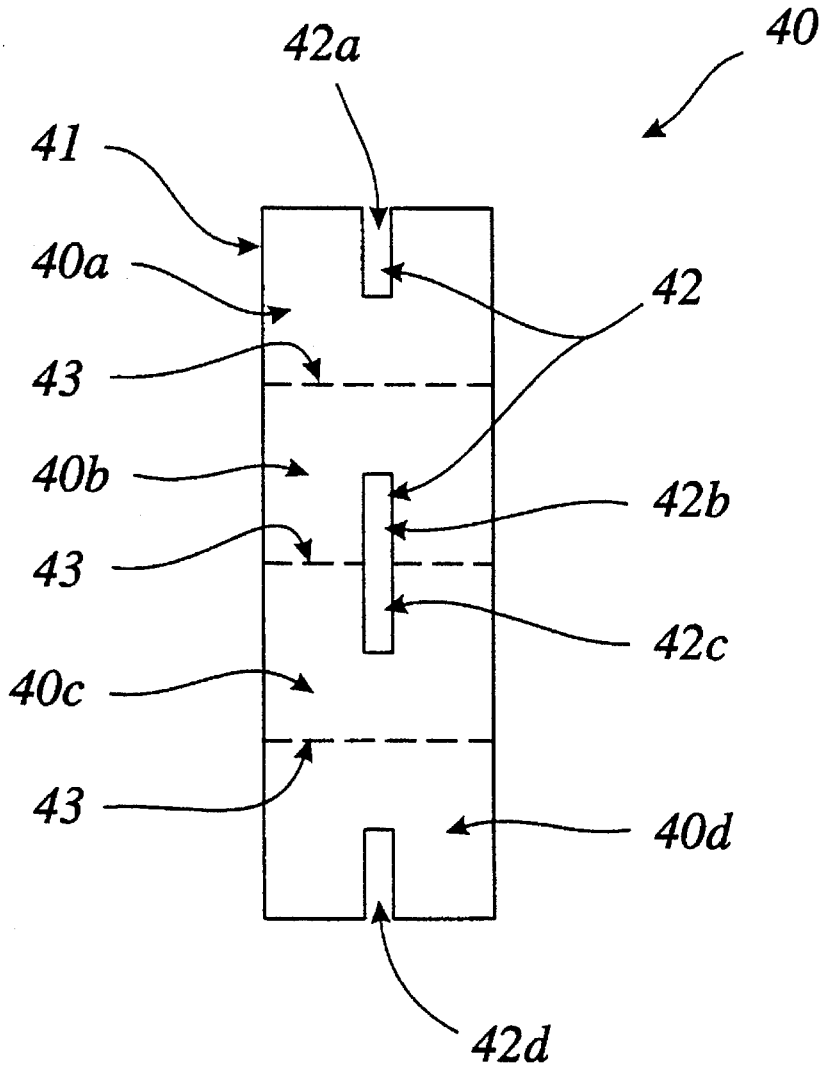
FIG. 2 is a top plan view of the blank to produce the brace.
Figure 4:
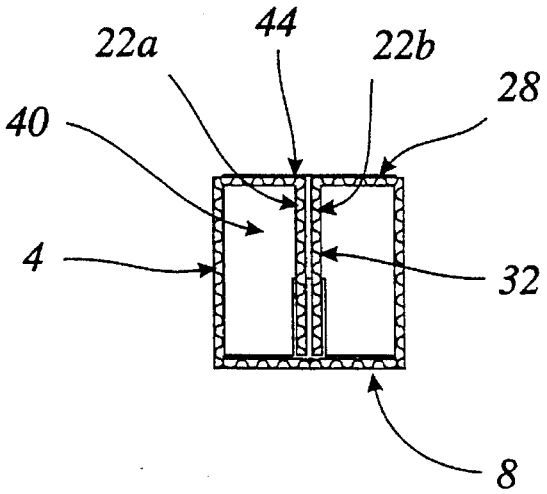
FIG. 4 is an end view of the assembled runner.
Figure 5:
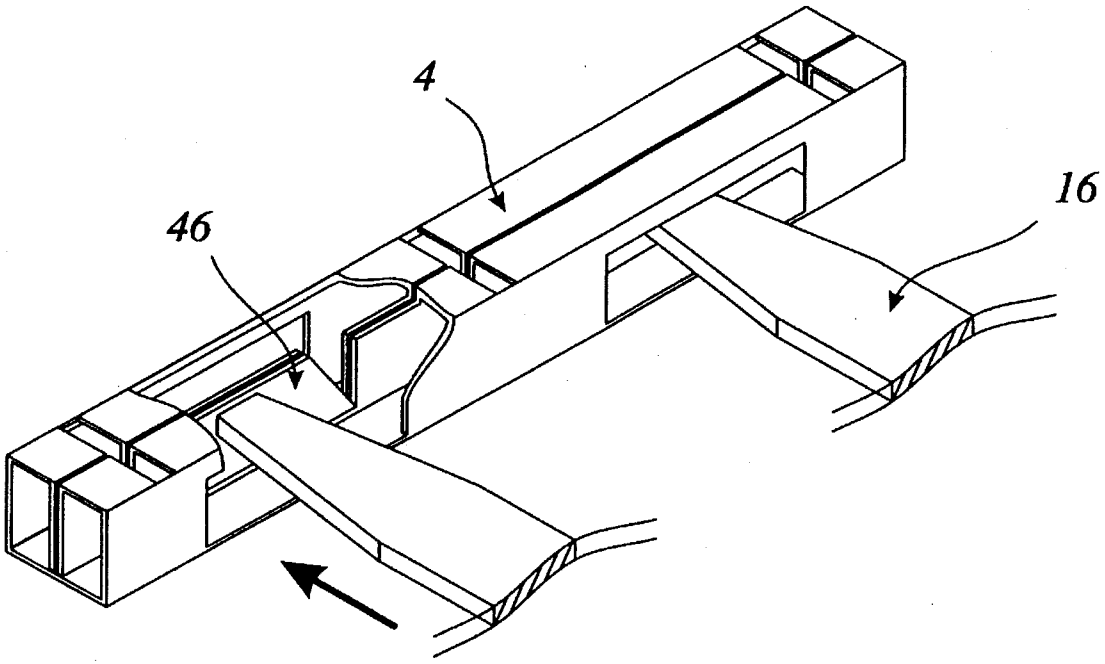
FIG. 5 is a partial exploded view of the runner.

The runner 4 and particularly the slots 30 are adapted to admit a brace 40. The brace 40 is folded from a piece of paperboard blank shown in FIG. 2. In the preferred embodiment brace 40 comprises four plies, 40*a*, 40*b*, 40*c*, and 40*d*. Blank 41 includes slots 42*a*, 42*b*, 42*c*, and 42*d*. Brace 40 is foldable along folds 43, in accordion fashion as best shown in FIG. 3 so as to present a block 44. Slots 42*a*, 42*b*, 42*c*, and 42*d* are disposed centrally with respect to width but to one edge with respect of the longitudinal extent of each of plies 40*a*, 40*b*, 40*c*, and 40*d*, respectively such that those slots are aligned to form a single finished slot 42. Block 44 is adapted to be inserted into any of slots 30 so as to seat in a rebate 31 and thereby to engage and lock the folded runner as best shown in FIG. 4. In this position block 44 is disposed to contact substantially perpendicularly about its periphery bottom wall 8 and side walls 12*a* and 12*b*. Slot 42 is of sufficient width to locate about central web 32, and sufficient depth that block 44 seats in any of slots 30 more or less flush with top wall 28. Block 44 is restrained longitudinally with respect to central web 32 by edges 29*a* and 29*b*. Such assembly shown in FIG. 4 produces a strong yet easily constructed runner. More simply, block 44 is of approximately the same height as central web 32 plus the thickness of top wall 28. The depth of slot 42 plus the depth of rebate 31 is therefore approximately equal to the height of web 32. In the preferred embodiment slot 42 and rebate 31 are approximately equal depth, and the toes of slotted block 44 both abut wall 8.

In other words, once the runner blank 2 is folded or rolled so as to meet in the middle as shown in FIG. 3, the braces 40 are accordion folded and are inserted into the slots 30 that are cut into the top 28 of the runner 4. The top 28 of the runner 4 is divided into two panels 20.

The central web 32 and in particular, the central wall portions 22 include flaps 46 that remain in place to enhance the strength of the runner 4. When a fork lift 16 is driven into the runner 4, the flaps then fold downward to allow entry as best shown in FIG. 6.

Figure 7:
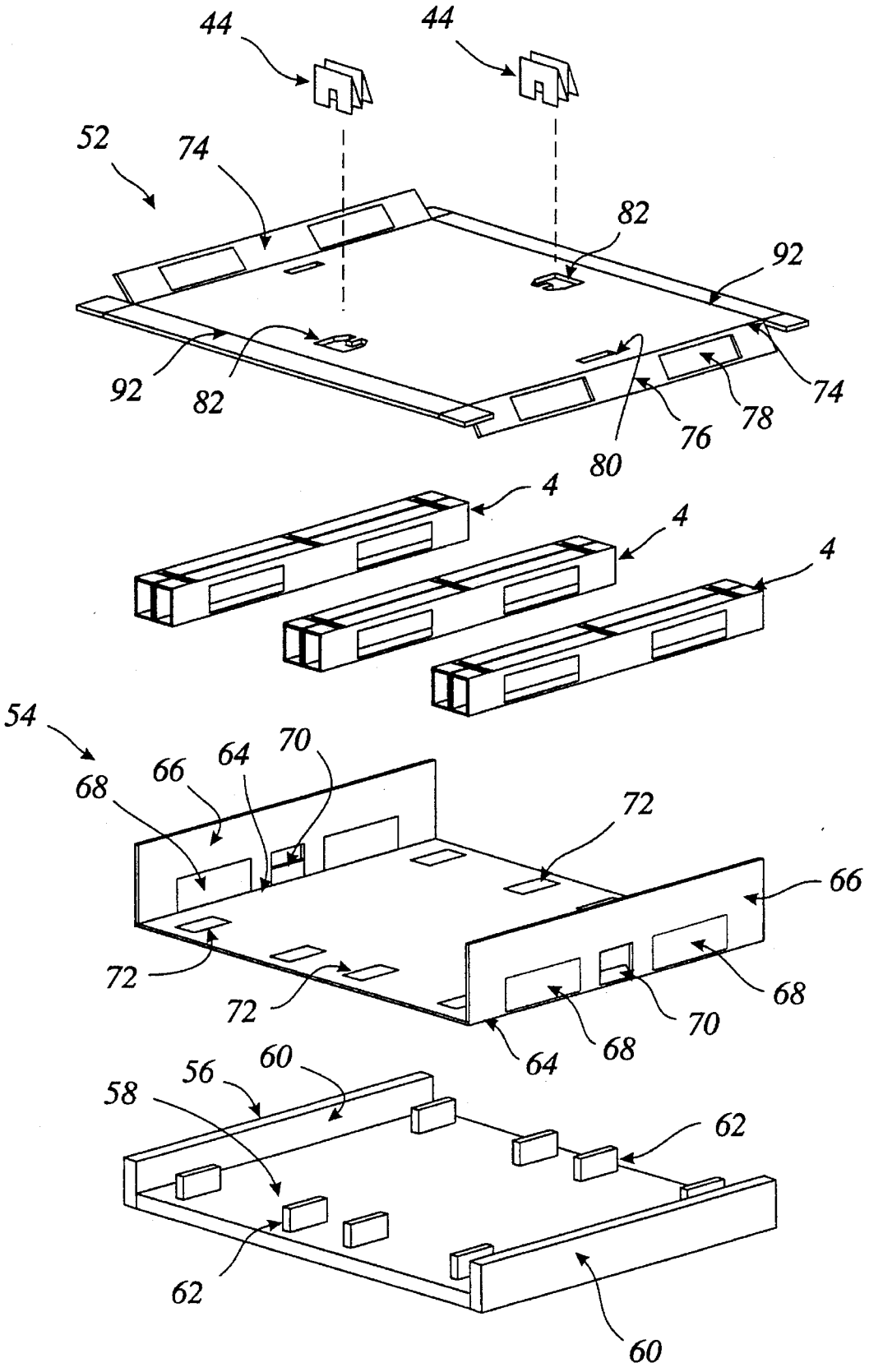
FIG. 7 is an exploded view of the paperboard pallet showing the top sheet, runners, bottom sheet and plywood jig.
Figure 11:
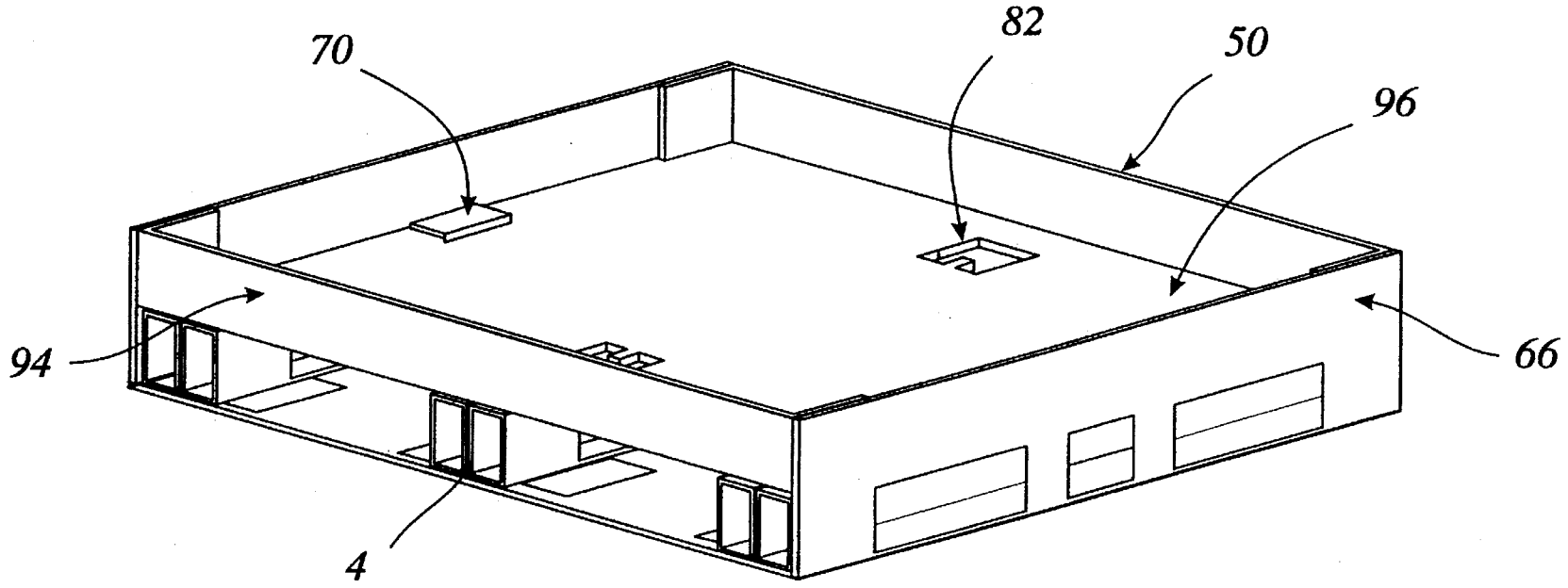
FIG. 11 is an assembled view of the paperboard pallet.

FIG. 7 illustrates a paperboard pallet 50 which is best shown in FIG. 11 in its constructed form.

The paperboard pallet 50 comprises of a top sheet 52, a plurality of runners 4 as previously discussed as well as a bottom sheet 54.

A plywood jig 56 is also shown in FIG. 7.

The plywood jig 56 is adapted to receive the bottom sheet 54 and to register therewith. In other words the plywood jig 56 includes a jig bottom 58, jig upstanding sidewall 60 and engaging member 62.

The bottom sheet 54 is comprised of paperboard such as cardboard or the like, and includes a pair of fold lines 64 for defining upstanding bottom sheet sidewall portions 66.

The bottom sheet sidewall portion 66 include a series of holes 68 which are adapted to receive the fork lifts 16 of a fork lift. Moreover, the sidewall portions 66 include side flap 70. The bottom sheet 54 also includes a plurality of apertures 72 which are adapted to lovingly engage the member 62 for alignment.

The paperboard pallet 50 also includes a plurality of runners 4 which are constructed in accordance with the teachings outlined above.

The top sheet 52 also includes a pair of fold lines 74 so as to produce upstanding or depending top sheet sidewall formations 76, each of which include aligned holes 78 for receiving the fork lifts 16 of a fork lift truck.

Figure 10:
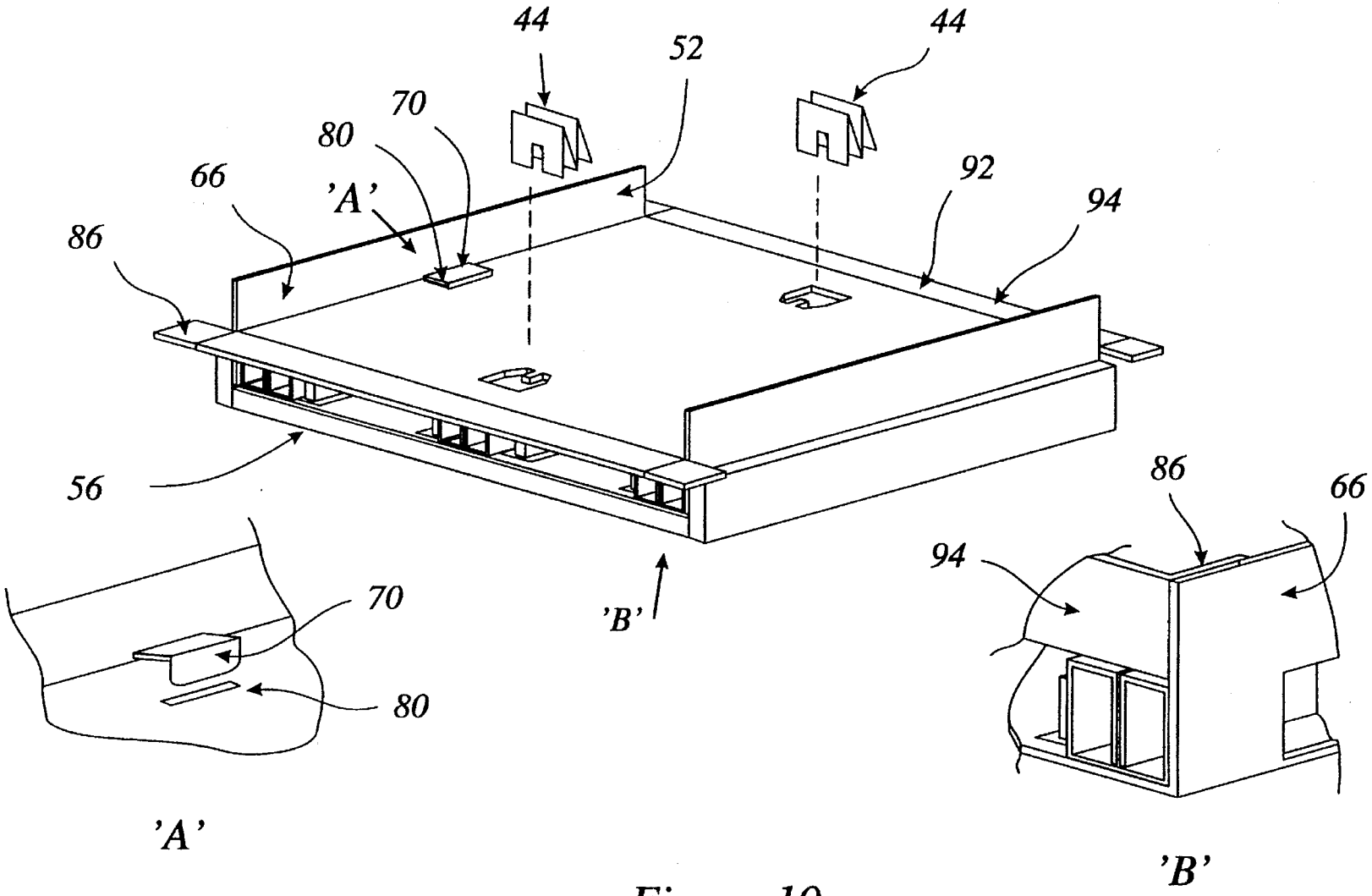
FIG. 10 is a further assembly view of the paperboard pallet.

The top sheet 52 also includes sheet slots 80 which are adapted to receive the side flaps 70 as best shown in FIG. 10.

Figure 8:
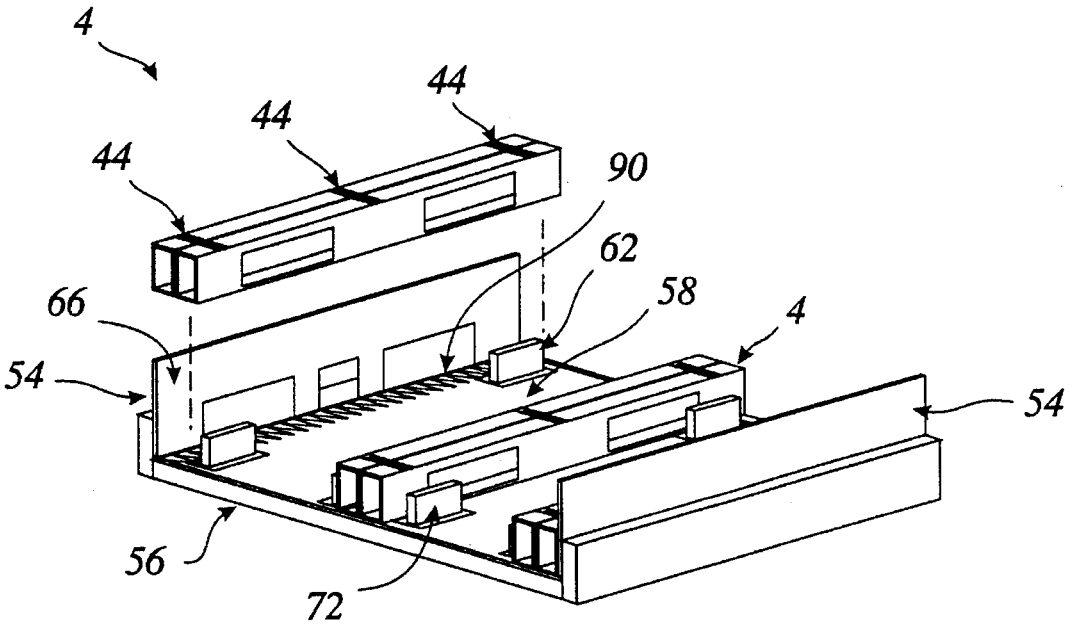
FIG. 8 is a partial assembly view of the paperboard pallet.
Figure 9:
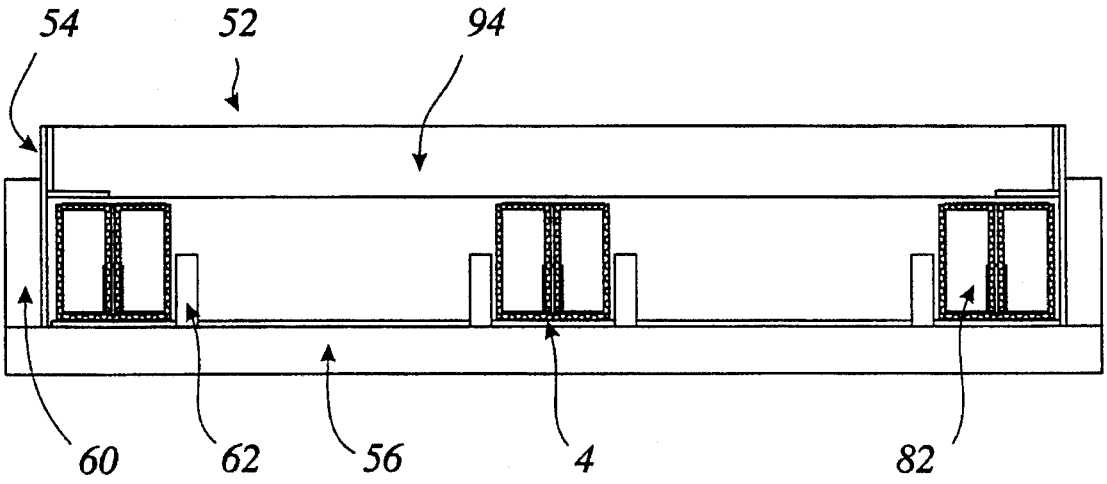
FIG. 9 is an end view of the paperboard pallet.

The top sheet 52 also includes cutouts 82 for receiving the folded braces 44. The bottom sheet 54 is received by the plywood jig 56 as best shown in FIG. 8 an adhesive 90 such as glue or the like is applied to the bottom sheet 54 where the runners 4 will be secured thereto. In particular three runners 4 will be secured to the bottom sheet 54. One runner 4 will be glued to one of the bottom sheet upstanding sidewall formations 66 while the other runner 4 will be adhesively secured adjacent the other bottom sheet upstanding side wall formation 66 shown in FIG. 8. A third runner 4 will be adhesively secured to the bottom sheet 54 between the other two runners as shown in FIG. 8.

Thereafter there will be applied to the top wall formations 20 of the runners and the top sheet 52 applied thereto as shown in FIG. 10.

The side flaps 70 will be folded over the top sheet 52 so as to be inserted into the top sheet slots 80, again as shown in FIG. 10. The braces 44 will be inserted into the cutouts 82 for the middle runner 4 as shown in FIGS. 7 and 10. However, it should be apparent that the folded braces 44 will also be inserted into the corresponding slots 30 of the other two runners so as to rigidify the structure in accordance with the teachings outlined above.

The top sheet 52 also includes a pair of top sheet fold lines 92 so as to define upstanding top sheet side wall formation 94 which are adapted to be secured to the bottom sheet upstanding sidewall formations as shown in the enlarged view in FIG. 10. The flap 86 of the upstanding wall 94 may be secured to the upstanding wall 66 by means of glue or staples.

An assembled view of the paperboard pallet is shown in FIG. 11. It should also be noted that the upstanding sidewalls 66 and 94 are configured so as to present a tapered tray 96 so as to enhance nesting of corresponding paperboard pallets.

Figure 12:
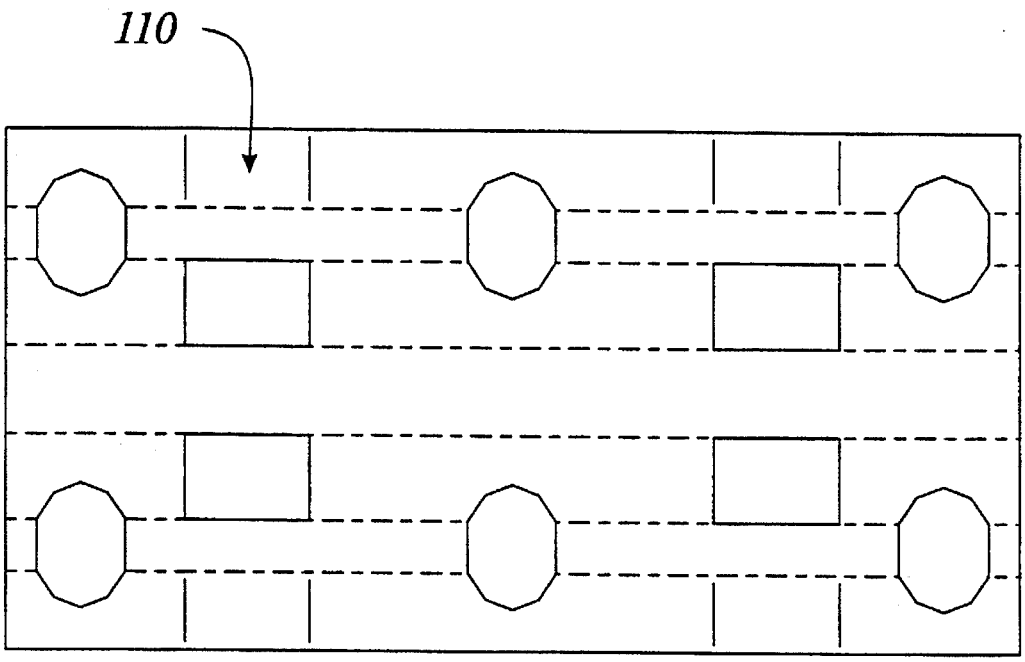
FIG. 12 is a top plan view of the blank for a second embodiment of the runner.
Figure 13:
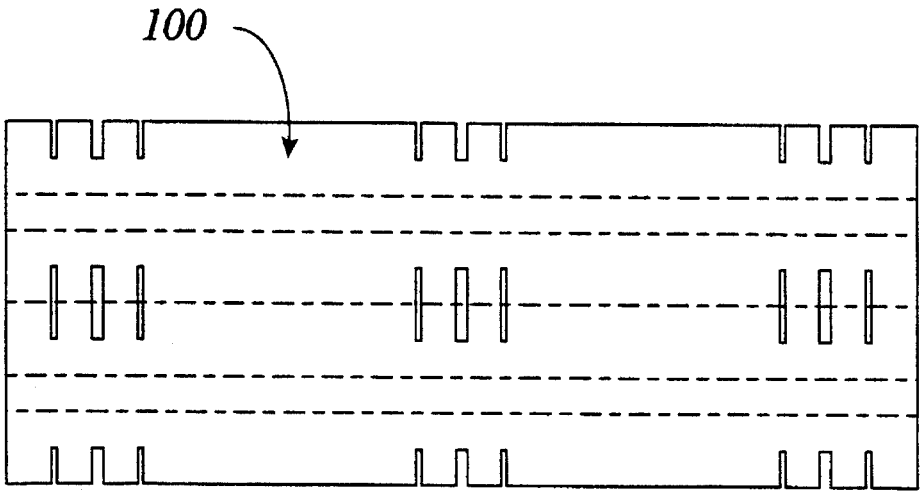
FIG. 13 is a top plan view of a stringer associated with a runner in FIG. 12.

FIGS. 12 and 13 illustrate another embodiment of the invention showing runners and stringers.

Figure 14:
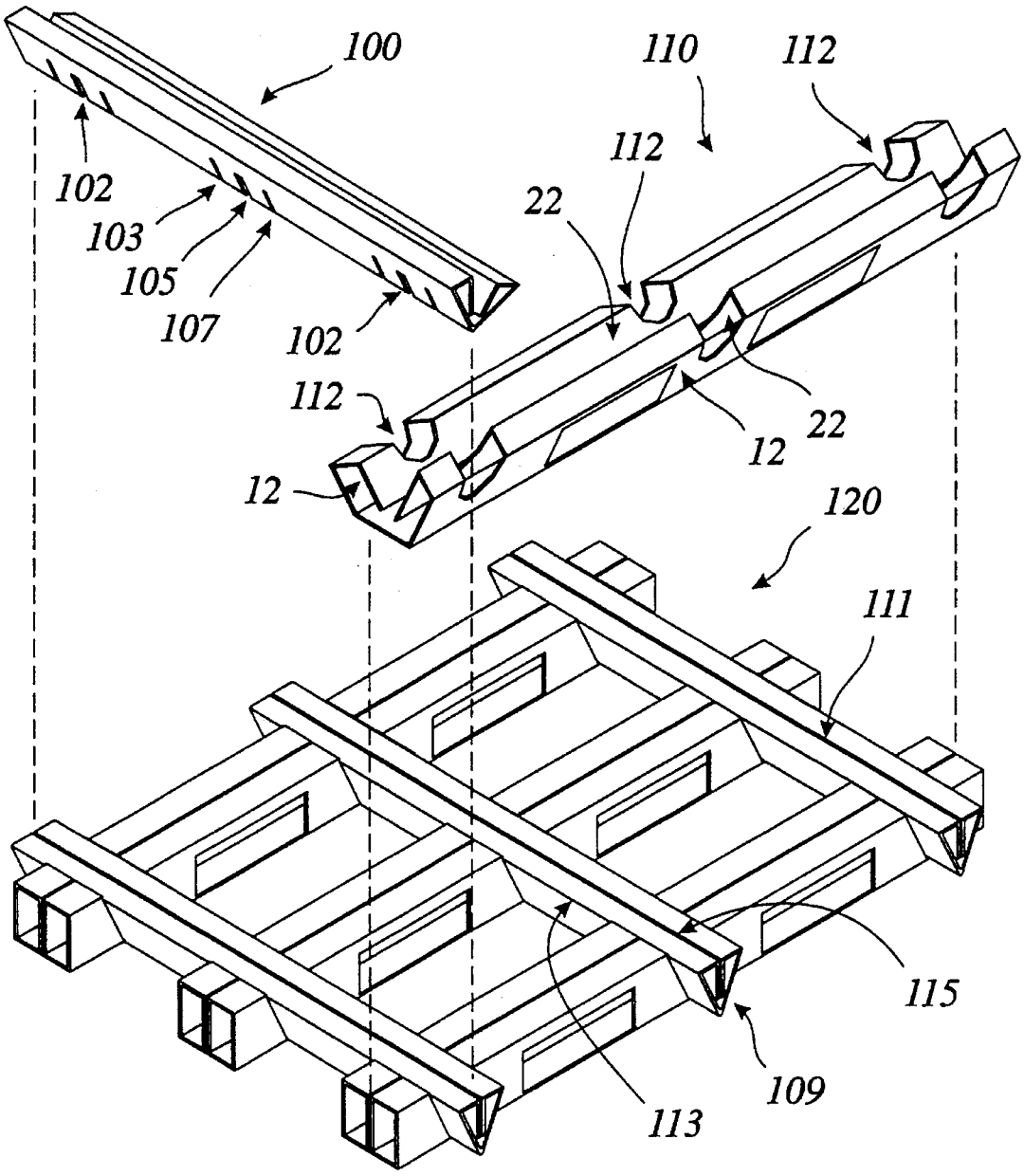
FIG. 14 is an assembly view of the runner and stringer of FIGS. 12 and 13.

FIG. 14 illustrates an assembled view of the stringers 100 and runner 110 to produce the pallet 120.

The runner 110 includes slots 112 which are similar to the slots 30 of the previous drawings but which slots continue along the sidewalls 12. The stringers 100 also include a plurality of slots 102. In particular, the slots 102 comprise of a series of slots 103, 105 and 107. The slots 103 and 107 are configured and dimensioned so as to receive and embrace the upstanding sidewalls 12 of the runner 110. Moreover, the slot 105 is configured and dimensioned so as to receive and embrace the two central walls 22 of runner 110 as best illustrated in FIG. 14.

Figure 15:
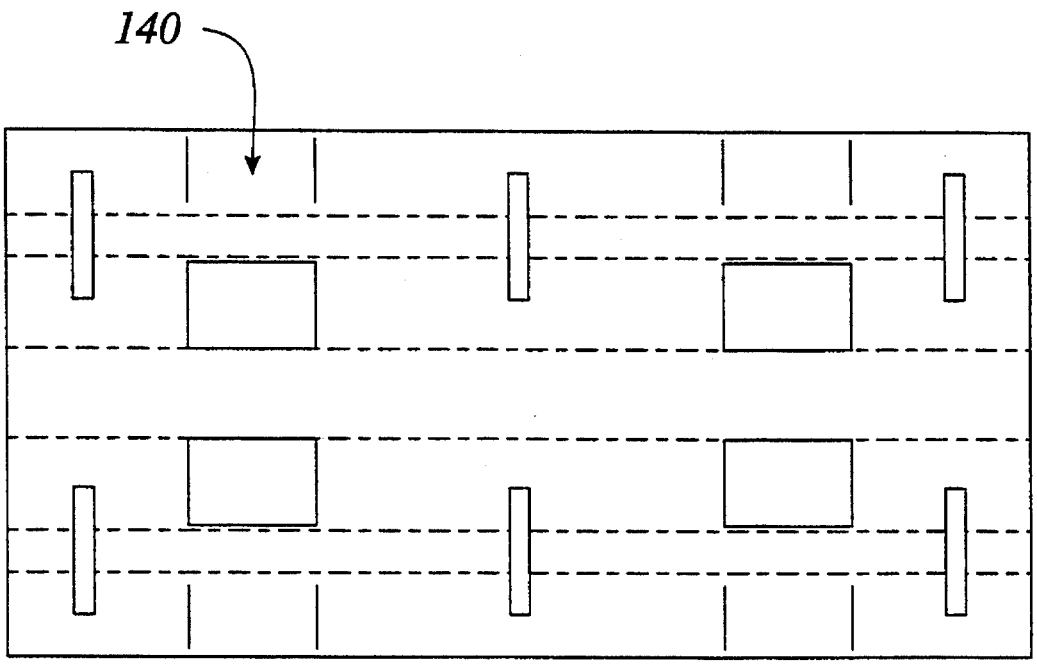
FIG. 15 is a top plan view of a blank for a further alternative embodiment of the runner.
Figure 16:
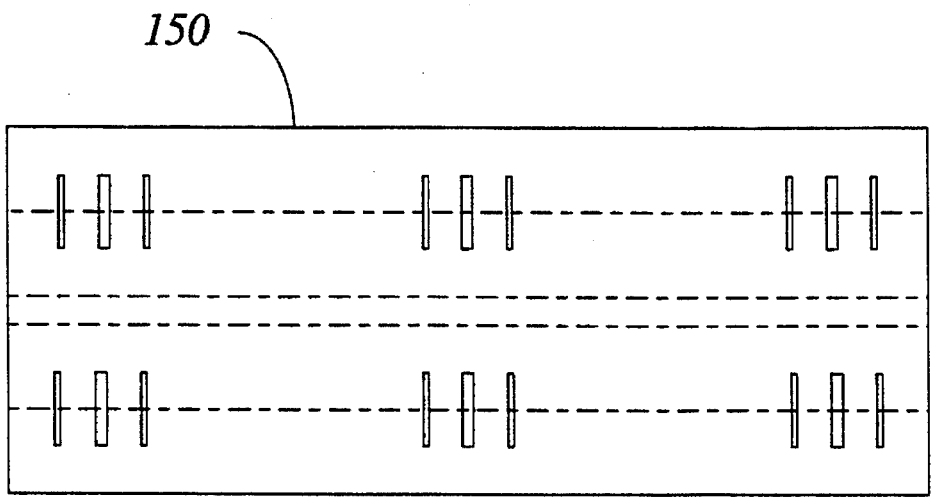
FIG. 16 is a top plan view of the blank for a stringer associated with the runner of FIG. 15.
Figure 17:
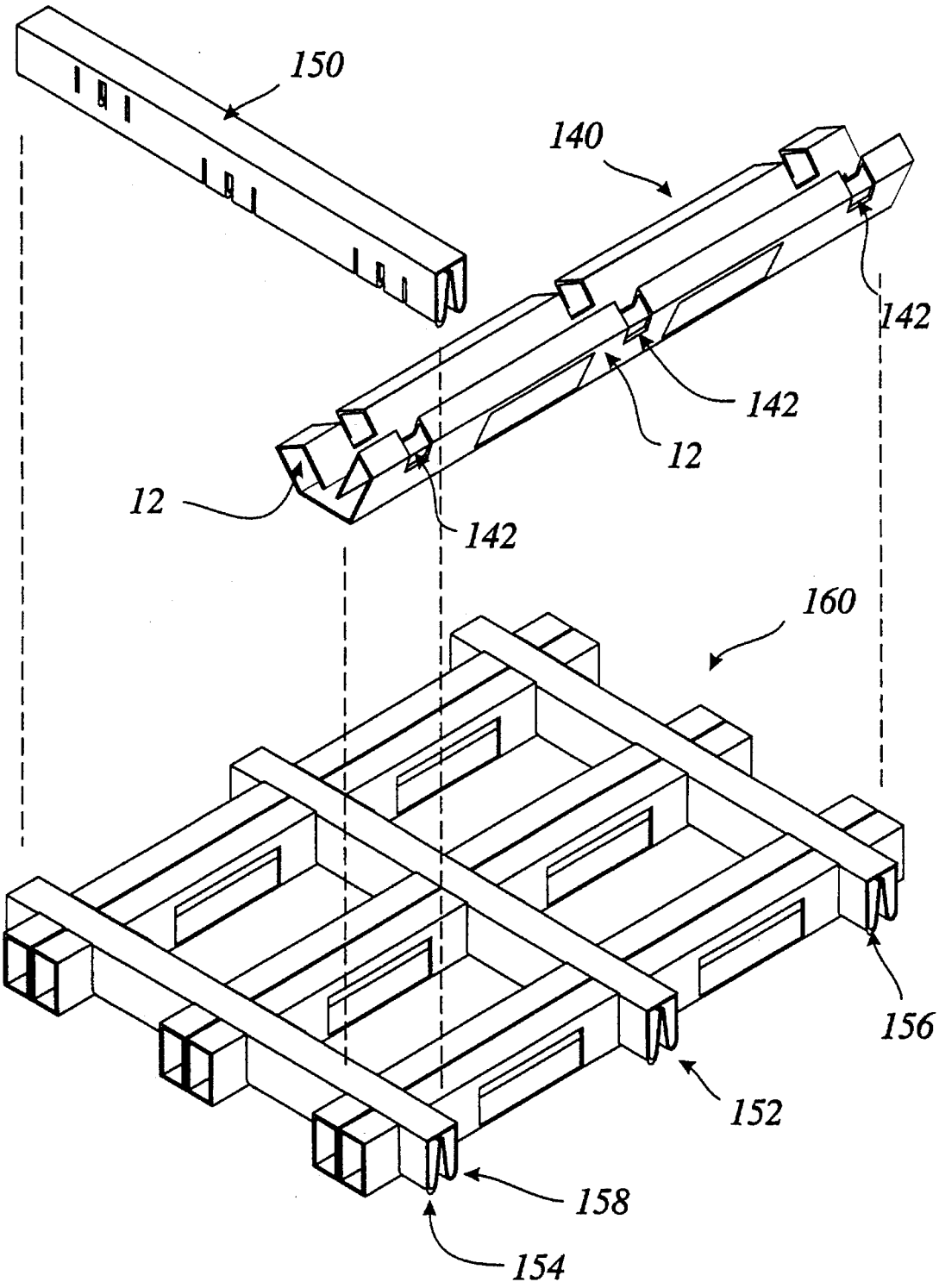
FIG. 17 is an assembly view of the runner and stringer of FIGS. 15 and 16.

FIGS. 15 and 16 show a further alternate embodiment of the invention. In particular, FIG. 17 shows the assembled view of the runner 140 of FIG. 15 and stringer 150 of FIG. 16. The runner 140 and stringer 150 are assembled so as to present the pallet 160 of FIG. 17.

The runner 140 also includes slots 142 which are similar to the slots 30 as previously described, but which slots 142 continue along the sidewalls 12. The stringer 150 is similar to the stringer 100 as shown in FIG. 14, except that the stringer 150 is folded so as to present a generally rectangular cross-section 152 as best shown in FIG. 17 while the stringer 100 of FIG. 14 is configured to present a triangular cross-section 109 as best shown in FIG. 14. Moreover, the rectangular cross-section 152 of stringer 150 presents a bottom surface 154 which presents two folded portions 156 and 158 while the stringer of FIG. 14 presents a folded top portion 111 having two folded upper portions 113 and 115.

Figure 18:
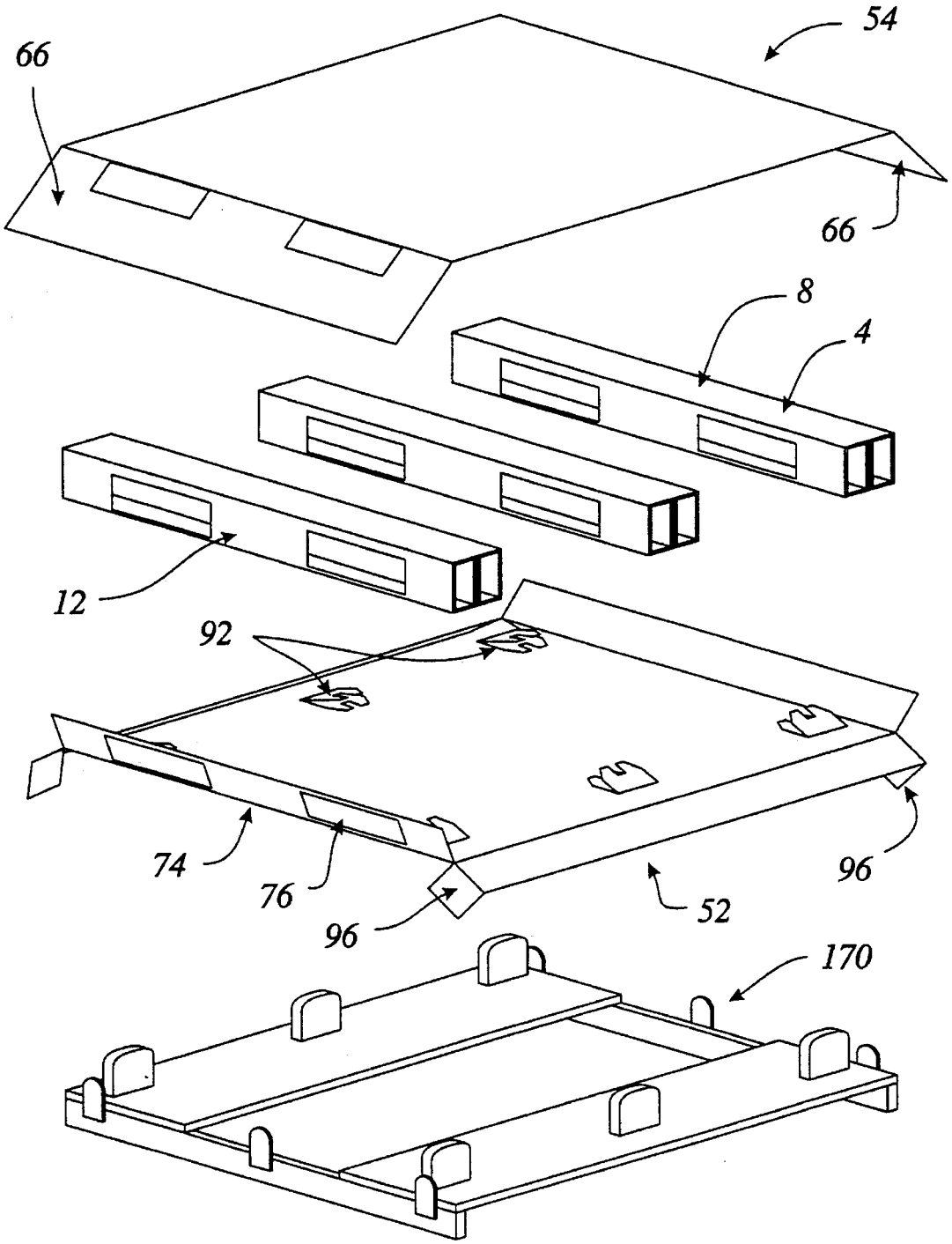
FIG. 18 is an exploded view of another embodiment of the paperboard pallet with an alternative plywood jig assembly method.
Figure 19:
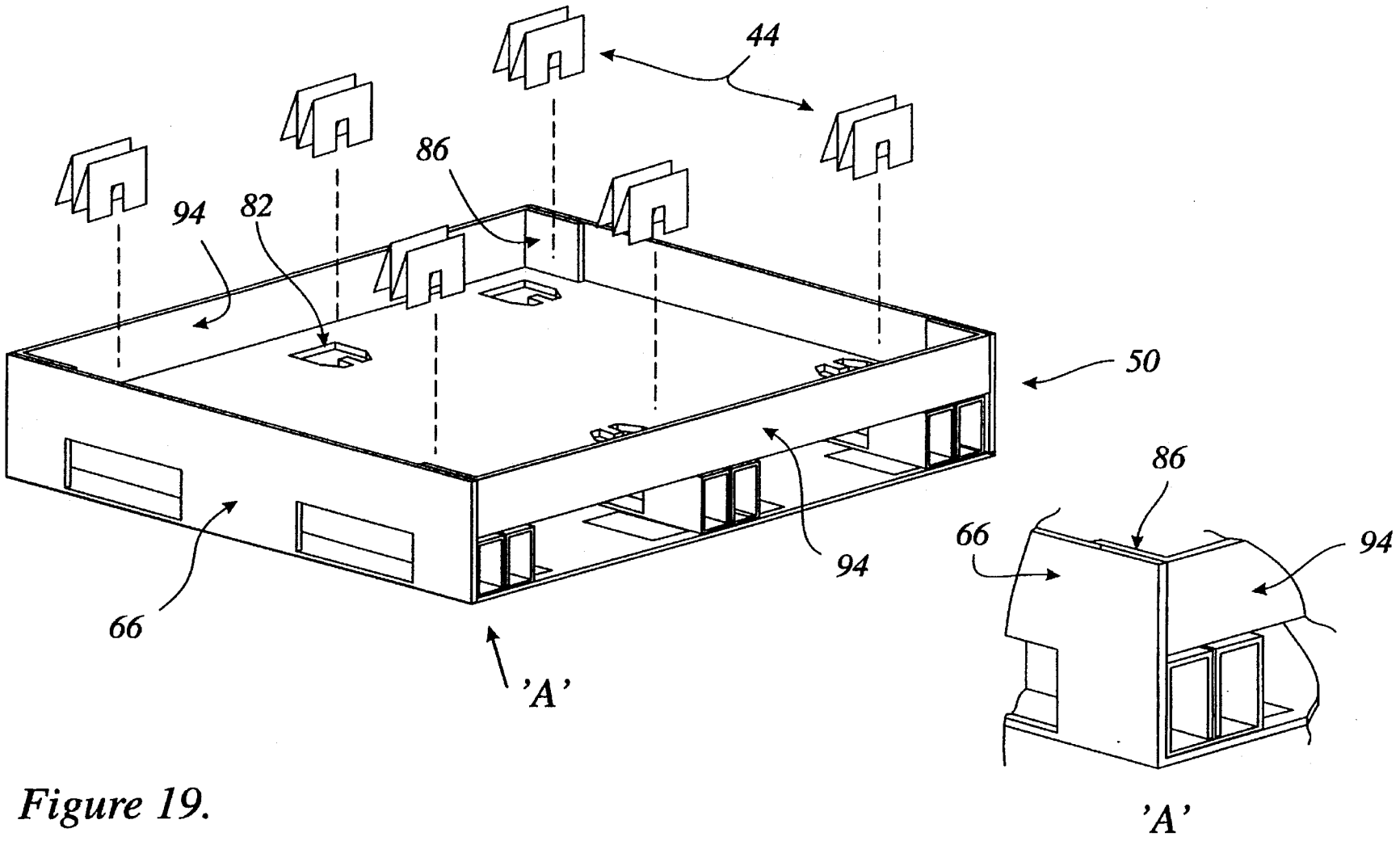
FIG. 19 is an upright view of the pallet shown in FIG. 18.

FIGS. 18 and 19 shown an alternate method of constructing a pallet similar to the exploded view of FIG. 7 except that the jig 170 is differently configured and adapted to receive the top sheet 54 with runners 4 and bottom sheet 54 overlying the assembly.

Moreover, FIG. 19 illustrates that the flaps 70 shown in FIG. 11 have been eliminated. The elimination of flap 70 can be compensated by stapling upstanding wall 66 to the side wall 12 of runner 4 and wall 76 of sheet 52.

Moreover, as a further embodiment of the invention the tray shown in FIGS. 11 and 19 may be eliminated.

Finally, FIG. 19 illustrates that the top sheet can include a plurality of flaps 82 which are adapted to receive the blocks 44.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A runner for a pallet comprising a sheet of paperboard folded to present spaced top and bottom walls; a pair of side walls, a central web disposed between said side walls and depending from said top wall to said bottom wall; the top wall having top wall slots; the central web having central web slots each of said aligned with said central web slots aligned with one of said top wall slots; and at least one brace of paperboard having a plurality of folds to present a slotted block for engagement with one of said central web slots.

2. A runner as claimed in claim 1 wherein said bottom wall presents a continuous bottom wall.

3. A runner as claimed in claim 2 wherein said side walls present holes to permit fork lift entry.

4. A runner as claimed in claim 3 wherein said top wall comprises a pair of top wall portions.

5. A runner as claimed in claim 4 wherein said central web comprises a central wall portion depending from each said top wall portions.

6. A runner as claimed in claim 5 wherein said central wall portions include flaps for strengthening said runner, said flaps in alignment with said holes and foldable to permit fork lift entry.

7. A runner as claimed in claim 6 wherein said brace is accordion folded.

8. A runner for a pallet comprising a folded sheet of paperboard and a brace:

(a) said sheet comprising:

(i) a first pair of spaced parallel fold lines for defining a bottom wall;

(ii) a second pair of parallel fold lines spaced from and parallel to said first pair of parallel fold lines for defining a pair of side walls between said first fold lines and said second fold lines;

(iii) a third pair of parallel fold lines parallel to, and bracketing said second pair of parallel fold lines for defining top wall portions between said second pair of fold lines and said third pair of fold lines;

(iv) a pair of longitudinal edges parallel to and bracketing said third pair of fold lines to define central wall portions therebetween;

(v) at least one pair of longitudinally aligned cut-outs, each pair of longitudinally aligned cut-outs extending from one of said second fold lines across said top wall portion, across said third fold line and across a portion of said central wall portion to define a top wall slot portion in said top wall and a central wall rebate in said central web portion;

(vi) said sheet foldable along said first, second and third fold lines to a folded position;

(vii) said central wall portions depending from said top wall portions to said bottom wall in said folded portion;

(viii) each pair of aligned top wall slot portions cooperating to define a top wall slot in said folded position;

(b) said brace comprised of paperboard having a plurality of folds to present a slotted block for insertion through said top wall slot to seat in said rebate.

9. A runner as claimed in claim 8 wherein said side walls present holes to permit fork lift entry.

10. A runner as claimed in claim 9 wherein said central wall portions include flaps for strengthening said runner, said flaps in alignment with said holes and foldable to permit fork lift entry.

11. A paperboard pallet comprising:

(a) a bottom sheet having a pair of spaced fold lines for defining a pair of spaced upstanding bottom sheet sidewall portions.

(b) a runner comprising a sheet of paperboard having:

(i) a first pair of spaced parallel fold lines for defining a bottom wall;

(ii) a second pair of parallel fold lines spaced from said first pair of parallel fold lines for defining a pair of side walls;

(iii) a third pair of parallel fold lines spaced from said second pair of parallel fold lines for defining top wall portions, and central wall portions from said third pair of parallel fold lines and said outer periphery of said paperboard;

(iv) said central wall portions depending from said top wall portions to said bottom wall;

(v) slots extending from said second fold lines across said top wall portions and a portion of said central wall portions;

(c) a top sheet for overlying said top wall of said runner;

(d) an adhesive for securing said bottom wall of said runner to said bottom sheet and said top portions of said runner to said top sheet;

(e) a brace of paperboard having a plurality of holes to present a slotted block for insertion into said slots of said runner.

12. A paperboard pallet as claimed in claim 11 including three runners, one adjacent each said upstanding bottom sheet sidewall portions with said third runner between said other two runners.

13. A paperboard pallet as claimed in claim 12 wherein said upstanding sidewall portions include side flaps and said top sheet includes slots for receiving said flaps so as to secure said top sheet to said runners.

14. A paperboard pallet as claimed in claim 13 wherein said top sheet has a pair of spaced fold lines for defining a pair of spaced upstanding top sheet sidewall portions, cooperating with said pair of spaced upstanding bottom sheet sidewall portions so as to define a top tray.

15. A paperboard pallet as claimed in claim 14 wherein said top sheet includes top sheet slots aligned with said slots of said top wall portions and central wall portions of said third runner.

16. A runner as claimed in claim 8 wherein said top wall slot portions extend across a portion of said side walls, which slot portions engage with a plurality of slots presented by stringers.

17. A runner as claimed in claim 16 wherein said stringer has a generally triangular cross-section.

18. A runner as claimed in claim 16 wherein said stringer has a generally rectangular cross-section.

* * * * *